United States Patent [19]

Magedanz et al.

[11] 4,419,216

[45] Dec. 6, 1983

[54] PROCESS OF RECOVERING OIL FROM OIL-CONTAINING MATERIALS

[75] Inventors: Norbert Magedanz, Hasselroth; Horst Seidel; Hans J. Weiss, both of Frankfurt am Main, all of Fed. Rep. of Germany

[73] Assignee: Metallgesellschaft Aktiengesellschaft, Frankfurt am Main, Fed. Rep. of Germany

[21] Appl. No.: 387,074

[22] Filed: Jun. 10, 1982

[30] Foreign Application Priority Data

Jun. 19, 1981 [DE] Fed. Rep. of Germany ..... 3124277

[51] Int. Cl.[3] ..... C10G 1/02; C10B 53/06

[52] U.S. Cl. ..... 208/11 R; 208/8 R; 201/32

[58] Field of Search ..... 208/8 R, 11 R; 201/32, 201/14

[56] References Cited

U.S. PATENT DOCUMENTS

| | | | |
|---|---|---|---|
| 3,325,395 | 6/1967 | Ban | 201/32 X |
| 3,325,395 | 6/1967 | Ban | 208/8 R |
| 3,483,115 | 12/1969 | Haddad et al. | 201/32 X |
| 3,560,369 | 2/1971 | Rowland et al. | 201/32 X |
| 3,644,193 | 2/1972 | Weggel et al. | 208/11 R |
| 4,039,427 | 8/1977 | Ban | 201/32 X |
| 4,058,205 | 11/1977 | Reed, Jr. | 201/14 X |
| 4,193,862 | 3/1980 | Ban et al. | 208/11 R |

*Primary Examiner*—Delbert E. Gantz

*Assistant Examiner*—Glenn A. Caldarola

*Attorney, Agent, or Firm*—Sprung, Horn, Kramer & Woods

[57] ABSTRACT

In a process of recovering oil from oil-containing minerals on a traveling grate, hot gases are passed through the bed in a retorting zone, oil is separated from the retort gases in a separating stage, solid carbon in the retorted bed is burnt in a succeeding combustion zone by means of oxygen-containing gases passed through, gases from which the oil has been removed in the separating zone are passed through the bed in a succeeding cooling zone and the heated gases are recycled to the retorting zone.

To recover maximum quantities of oil and energy with a low expenditure, the solid carbon in the top layer of the bed is ignited by means of an ignition furnace at the beginning of the combustion zone, oxygen-containing gases are sucked through the bed thereafter to cause the burning zone to move through the bed, preferably the rate at which said oxygen-containing gases (19) are sucked through the bed (3) is so controlled that the bed is heated to the highest possible temperature by the combustion of carbon, a partial stream of the gases leaving the separating stage is heated by an indirect heat exchange with the exhaust gases from the combustion zone and is passed through the bed in the cooling zone and is further heated there and is then recycled to the retorting zone, and a partial stream of the gases leaving the separating zone is discharged.

9 Claims, 1 Drawing Figure

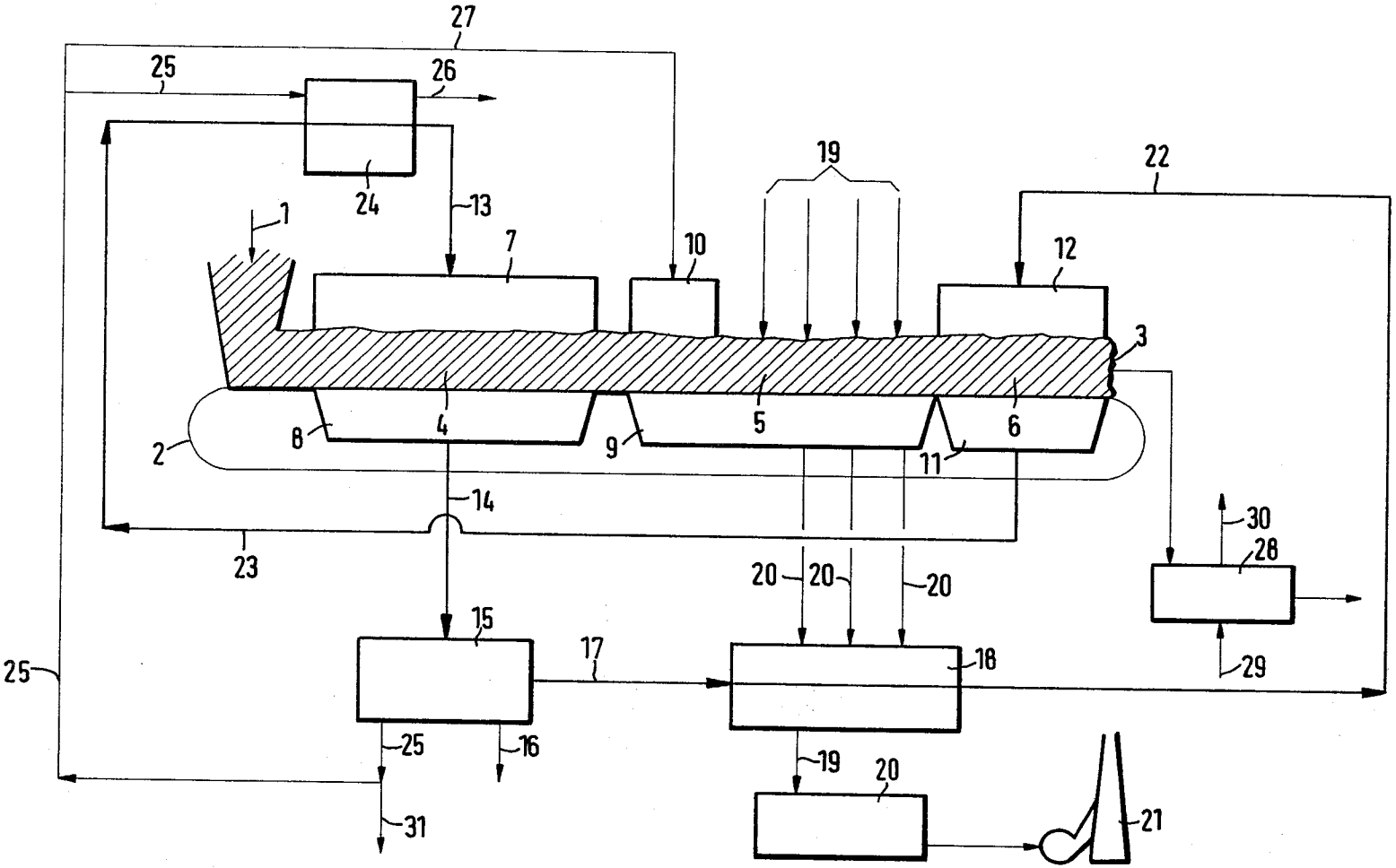
1
2
3
4
5
6
7
8
9
10
11
12
13
14
15
16
17
18
19
20
21
22
23
24
25
26
27
28
29
30
31

PROCESS OF RECOVERING OIL FROM OIL-CONTAINING MATERIALS

BACKGROUND OF THE INVENTION

1. Field of the Invention

This invention relates to a process of recovering oil from oil-containing minerals wherein the oil-containing mineral is charged onto a traveling grate, hot gases are passed through the bed in a retorting zone to heat the bed to the retorting temperature, the vaporous and gaseous retorting products are entrained by the retort gases, oil is separated from the retort gases in a separating stage, solid carbon in the retorted bed is burnt in a succeeding combustion zone by means of oxygen-containing gases passed through, gases from which oil has been removedin the separating zone are passed through the bed in a succeeding cooling zone, and the heated gases are recycled to the retorting zone.

2. Discussion of Prior Art

Oil-containing materials, such as oil sand, diatomaceous earth and particularly oil shale are heat-treated on traveling grates to recover their oil content. In the retorting zone, hot gases are passed through the bed to heat the latter to the retorting temperature of about 400° to 600° C. The hot gases are neutral or reducing gases so that the retorting is effected in the absence of oxygen. During the retorting various gases and vapors are formed from the organic constituents. The oils are condensed from the retort gases. After the condensation, the gas still contains gaseous retorting products which cannot be condensed. The retorted residue on the traveling grate contains solid carbon as a retorting product. For the sake of heat economy, that carbon must be burnt and the resulting heat must be utilized for the process.

It is known from U.S. Pat. No. 3,325,395 to pass hot non-oxidizing gases through the bed in a first zone of the traveling grate so as to effect retorting in said first zone only in the upper portion of the bed and to pass air through the bed in a second zone, so as to burn the solid carbon formed in the upper portion of the bed and to use the resulting hot gases to effect retorting in the lower portion of the bed. After the oils have been condensed, thegas is passed through thebed from below in the cooling zone and is thus heated and after a combustion of combustible constituents effected with a supply of air is recycled to the first retorting zone. A partial stream is branched from the gases leaving the cooling zone.

The combustion of the non-condensible constituents in the recycled gas stream decreases the heating value of the retort gases which have passed through the retorting zone and left the separating stage, because the percentage of the non-condensible combustible constituents is low. Additionally, part of the non-condensible constituents in the exhaust gas is lost. The non-condensible constituents formed in the second retorting zone are lost or form also a lean gas. In addition, an expensive control is required in order to maintain non-oxidizing conditions in the combustion zone for the solid fuel and it is hardly possible to maintain such non-oxidizing conditions.

It is known from U.S. Pat. No. 3,644,193 to conduct the gases from below through the bed in a first zone so as to preheat the bed to a temperature below the retorting temperature and to cool the gases, which are subsequently fed to a mechanical separating stage for a separation of the oils. Hot gases are passed through the bed in a second zone to effect retorting. Hot air is passed through a third zone to burn the solid carbon. The hot gases from the combustion zone are conducted in a round traveling grate through a bed of heat exchange bodies and heat the latter. The gas from the separating stage is passed through the heated heat exchange bodies and is thus heated and then recycled to the retorting stage. A partial stream of the gas from the separating stage is burnt and admixed to the gases from the combustion zone. The repeated separation of oil decreases the yield. The heat exchange with the aid of heat exchange particles is expensive and causes heat losses. The heat exchange bodies are spoiled by dust and must be cleaned.

It is known from U.S. Pat. No. 4,039,427 to effect a retorting and a subsequent cooling o a first traveling grate and a combustion of the solid carbon and of residual hydrocarbons on a second traveling grate. The retort gas from which the oil has been removed is forced through the cooling zone and is thus heated. One partial stream is discharged and another partial stream is passed through the hot bed of the second traveling grate and is further heated there and then fed to the retorting zone. Two traveling grates are required. The transfer of material from one traveling grate to the other involves heat losses, the heat loss due to the cooling on the first traveling grate must be compensated by a corresponding supply of energy on the second traveling gate, and the gas which leaves the cooling zone of the first traveling grate and contains non-condensible constituents is uselessly heated.

It is also known from U.S. Pat. no. 4,082,645 to effect retorting in the retorting zone only in the upper portion of the bed and to effect retorting in the combustion zone in the lower portion of the bed. Oxygen is passed through the bed at controlled rates. As the gases from all retorting zones and from the cooling zone are combined, only a lean gas becomes available when the oil has been separated. Besides, the previously described problems arise as regards the control of the oxygen content in the retorting zone.

It is known from U.S. Pat. No. 4,193,862 to suck oxygen-containing gases that contain 5 to 15% water through the bed behind a retorting zone in order to burn the solid carbon. After the separation of oil, the gases from the retorting zone are passed through the cooling zone and then recycled to the retorting zone. A partial stream is discharged from the end of the cooling zone. The dissociation of the water content in the combustion zone is an endothermic reaction, by which heat is consumed. For this reason the process can be used only if the content of solid carbon is sufficient so that there will be an overall heat surplus in the process. Additionally, when the oil has been separated a lean gas will be obtained and that partial current thereof which is discharged has been uselessly heated.

It is an object of the invention to avoid the disadvantages which have been described and particularly to permit a retorting and combustion with a minimum of expenditure for processing and control equipment and to recover as much oil and energy from the minerals supplied.

SUMMARY OF THE INVENTION

This object is accomplished in accordance with the invention in that the solid carbon in the top layer of the bed is ignited by means of an ignition furnace at the beginning of the combustion zone, oxygen-containing gases are sucked through the bed thereafter to cause the burning zone to move through the bed, the rate at which said oxygen-containing gases are sucked through the bed is so controlled that the bed is heated to the highest possible temperature by the combustion of carbon, a partial stream of the gases leaving the separating stage is heated by an indirect heat exchange with the exhaust gases from the combustion zone and is passed through the bed in the cooling zone and are reheated therein and is then recycled to the retorting zone, and a partial stream of the gases leaving the separating stage is discharged.

A virtually complete retorting is effected in the retorting zone. The combustion of the solid carbon in the combustion zone is preferably so controlled that the temperature in the bed and therewith in the exhaust gases is as high as possible. To this end, the oxygen-containing gases consisting generally of air are sucked through the bed at a controllable rate. That gas rate is increased until the exhaust temperature has reached a maximum. This is then the optimum gas rate. When the exhaust gas temperature drops, the gas rate is higher than the optimum. In that step, the solid carbon may not be completely burnt in some cases. This is tolerated. Particularly with large particles it may be more desirable to burn only the solid carbon in the external portions of the particles whereas the carbon in the interior of the particles is not burnt. Part of the gas withdrawn from the separating zone can be used to ignite the solid carbon in the combustion zone. In that case, the non-condensible, combustible retorting products contained in said gas are burnt too.

In an embodiment of the invention, the gases which have been heated further in the cooling zone are heated further to the retorting temperature by an additional heating in an indirect heat exchanger before they enter the retorting zone. That additional heating will be used if the gases to be recycled which have passed through the cooling zone do not yet have the required retorting temperature. The necessary heat can be supplied to the heat exchanger as energy from the process itself or an extraneous energy.

The heat content of the heating medium leaving the heat exchanger may be used to preheat combustible heating fluids before they enter the heat exchanger or to preheat the fuel for the ignition or to preheat the oil-containing minerals.

In a preferred embodiment, the additional heating is effected in that the partial stream of gas leaving the separating stage is burnt. In this way the heating value of said gases can be utilized in the process to the best extent.

In a preferred embodiment, the burnt material which has been discharged from the traveling grate behind the cooling zone is cooled further in a separate cooler in direct contact with gaseous cooling medium. In this way the further cooling to which burnt material is to be subjected before it is carried off can be effected in an economical manner and independently of the process carried out on the traveling grate.

In a preferred embodiment, the heat taken up by the cooling medium is returned to the process. The heat content of the cooling medium may be used to preheat oil-containing minerals or to preheat fuels and can thus be utilized in the process.

In a preferred embodiment, the gases fed to the retorting zone have about the same composition as the gases which become newly available as a result of the retorting without the condensible constituents. This is due to the fact that the gas leaving the separating stage has a high heating value.

BRIEF DESCRIPTION OF DRAWING

The invention will be explained more in detail with reference to the drawing which is a flow diagram showing one mode for carrying out the invention.

DESCRIPTION OF SPECIFIC EMBODIMENT

Referring to the drawing the oil-containing material 1 is charged onto the traveling grate 2. The bed 3 is carried through the retorting zone 4, combustion zone 5 and cooling zone 6 in succession. A gas hood 7 is mounted over the retorting zone 4 and wind (suction) boxes 8 are mounted under the retorting zone 4. Wind (suction) boxes 9 are mounted under the combustion zone 5 and the ignition furnace 10 is mounted over the beginning of the combustion zone 5. Wind (suction) boxes 11 are mounted under the cooling zone 6 and gas hood 12 is arranged above the cooling zone 6.

Hot gases are fed through a duct 13 and the gas hood 7 into the retorting zone 4 and there are sucked through the bed 3 into the wind (suction) boxes 8. The retort gases which contain retorting products are fed through the duct 14 to the separating stage 15, in which the oil is separated, which is discharged in conduit 16. A partial stream of gases from which oil has been removed is recycled and is fed through duct 17 to the indirect heat exchanger 18.

As the retorted bed 3 enters the combustion zone 5, the solid carbon in the surface of the bed is ignited under the ignition furnace 10. Air 19 is then sucked through the bed into the wind (suction) boxes 9 so that the burning zone moves through the bed from top to bottom. The hot exhaust gases are fed through ducts 20 to the heat exchanger 18, where they heat the gas that has been recycled from the separating stage, and are then fed through duct 19 to the gas cleaning unit 20 and discharged from the latter into the stack 21. The rate of air 19 in the combustion zone 5 is preferably so controlled that the bed 3 has the highest possible temperature at the end of the combustion zone. As a result, the exhaust gases entering the heat exchanger through 20 also have the highest possible temperature. The hot burnt bed 3 enters the cooling zone 6, in which the heated gases which are to be recycled are fed through duct 22 into the gas hood 12 and sucked through the bed 3 into the wind (suction) boxes 11. As a result, the bed 3 is cooled and the gas is heated further. The gas is fed through duct 23 into the indirect heat exchanger 24. The partial stream of gases from which oil has been removed in the separating stage 15 is conducted through duct 25 into the heat exchanger 24, in which the combustible, non-condensible retorting products contained in said partial stream are burnt. The flue gases leave the heat exchanger 24 through duct 26.

The gas to be recycled is heated in the heat exchanger 24 to the temperature required for retorting and is fed through duct 13 to the retorting zone 4. Part of the gas stream is conducted from duct 25 through duct 27 to the ignition furnace 10 and is burnt there. The precooled bed 3 is discharged from the traveling grate into a separate cooler 28, which is fed with air through duct 29 so that the material is cooled to a temperature at which it can be carried away. The heated cooling air is withdrawn through duct 30. The heated cooling air 30 and the flue gases 26 may be used to preheat oil-containing material before it is retorted or to preheat the gases in conduit 25. A surplus of gas which must be withdrawn from the separating stage is withdrawn through duct 31 and may be used for other purposes as a gas having a high heating value.

The advantages afforded by the invention reside in that the retorting and the combustion of the solid carbon can be effected in a technically simple manner on a traveling grate. A high oil yield is obtained. The heat generated in the process is optimally utilized and a gas having a high heating value is produced. The process permits a thermally self-sufficient treatment even of minerals which have a relatively low content of solid carbon after they have been devolatilized or less extraneous energy is required or more surplus heat is generated.

What is claimed is:

1. In a process of recovering oil from an oil-containing a mineral consisting essentially of charging, said oil-containing mineral onto a travelling grate, passing a hot gas through the bed in a retorting zone to heat the bed to the retorting temperature, entraining the resulting vapors and gaseous retorting products by the retorting gases, separating oil from the retort gases in a separating stage, burning solid carbon in the resultant retorted bed in a succeeding combustion zone by means of an oxygen-containing gas passed therethrough, removing gases from oil in the separating zone and passing said gasses through the bed in a succeeding cooling zone, and recycling the resultant heated gases to the retorting zone, the improvement wherein the retort gases are passed directly to said separating stage, the solid carbon in a top layer of said bed is ignited by means of an ignition furnace at the beginning of the combustion zone, oxygen-containing gases are sucked through the bed thereafter to cause the burning zone to move through the bed from top toward bottom, partial stream of the gas which is leaving the separating stage is heated by an indirect heat exchange with the exhaust gases from the combustion zone and is passed through the bed in the cooling zone, and are reheated therein and is then recycled to the retorting zone, and a partial stream of the gas that is leaving the separating stage is discharged.

2. A process according to claim 1, wherein the oxygen-containing gases are sucked through said bed at a rate so as to provide the highest possible temperature by the combustion of said carbon.

3. A process according to claim 1, wherein the gases which have been heated further in the cooling zone are heated further to the retorting temperature by an additional heating in an indirect heat exchanger before they enter the retorting zone.

4. A process according to claim 3, wherein the additional heating is effected by burning a partial stream of gas leaving the separating stage.

5. A process according to claim 1, wherein the burnt material which has been discharged from the traveling grate behind the cooling zone is cooled further in a separate cooler in direct contact with gaseous cooling medium.

6. A process according to claim 5, wherein heat taken up by the cooling medium is returned to the process.

7. A process according to claim 1, wherein the gases fed to the retorting zone have substantially the same composition as the gases which become newly available as a result of the retorting process, without the condensible constituents.

8. A process according to claim 1 wherein the gases from the cooling zone are recycled directly to the retorting zone.

9. A process according to claim 1 wherein a partial stream of oil-free gas from said separating stage is passed to a burner and burnt therein, said burner being one through which passes said gas from aid cooling zone en route to said retorting zone.

* * * * *